United States Patent [19]

Masuri

[11] Patent Number: 4,679,783

[45] Date of Patent: Jul. 14, 1987

[54] APPARATUS FOR OPENING SIGNATURES TO BE SUPPLIED TO BINDING MACHINES

[76] Inventor: Antonio Masuri, Via G. Mameli, 11, 20129 Milano, Italy

[21] Appl. No.: 877,299

[22] Filed: Jun. 23, 1986

[30] Foreign Application Priority Data

Jul. 26, 1985 [IT] Italy ..... 21726 A/85

[51] Int. Cl.[4] ..... B65H 39/02

[52] U.S. Cl. ..... 270/54; 270/57; 271/196

[58] Field of Search ..... 270/52, 54, 55, 57, 270/58; 271/11, 12, 90, 91, 94, 96, 196, 197

[56] References Cited

U.S. PATENT DOCUMENTS

| | | | |
|---|---|---|---|
| 2,627,074 | 1/1953 | Vogt | 271/94 X |
| 3,219,339 | 11/1965 | Gutierrez | 271/94 X |
| 3,552,740 | 1/1971 | Hepp | 270/54 |
| 3,554,532 | 1/1971 | Cosgrove | 270/54 |
| 4,463,940 | 8/1984 | Mock | 270/54 |

*Primary Examiner*—E. H. Eickholt
*Attorney, Agent, or Firm*—Bucknam and Archer

[57] ABSTRACT

Apparatus for opening signatures comprises a conveyor having a concave section onto which, in use, the signatures to be opened are deposited. Above this concave section of the conveyor there is disposed a series of rotating suckers mounted on a movable frame which is joined to a mechanism for displacing it with a reciprocating arcuate movement which follows the curve of the concave section of the conveyor. The rotating suckers are carried on bars mounted eccentrically and rotatably on associated suction heads. These bars are hollow and communicate, through a duct, with a suction source, the communication being controlled by a solenoid valve. Each of the said eccentric bars is driven to rotate by a spindle to which is rigidly connected a sprocket engaged by a slidable chain which acts as a rack.

9 Claims, 6 Drawing Figures

APPARATUS FOR OPENING SIGNATURES TO BE SUPPLIED TO BINDING MACHINES

BACKGROUND OF THE INVENTION

The present invention relates to apparatus for opening signatures intended to be supplied to binding machines; in particular the invention relates to improved signature-opening apparatus capable of operating at a high rate.

As is known, for supplying certain types of binding machines, for example stitching machines, it is necessary first to open the signatures at their centre, and this must be done regardless of the number of sheets or additional tables of which the signatures themselves are composed. This operation is currently performed by means of machines equipped with suckers which operate by taking the individual signatures from a magazine and opening them sheet by sheet using the suckers until reaching the middle; the signatures are then disposed with the opening oriented downwardly straddling a saddle.

Such known machines, however, have certain functional disadvantages because of the delicacy of the operations which they perform. In particular, a major disadvantage is the limitation of the speed at which the signatures can be handled, which is imposed by the structure of the known machines and the way they operate. Any attempt to increase the speed of operation of currently known commercially available machines would result in an increase in the speed of movement of the suckers which lift the sheets and, therefore, an increase in the speed and violence with which the sheets are raised and folded back. In practice, therefore, the possibility of making the known machines operate faster is prevented by the mechanical and geometrical characteristics of the paper and the signatures, such as the direction of the fibres, defects in the flatness of the paper, warping and such like.

OBJECTS OF THE INVENTION

A primary object of the present invention, therefore is to overcome or at least reduce the disadvantages and limitations of previously known signature-opening machines.

Another object of the present invention is to provide improved apparatus for opening signatures, which is able to perform the signature-opening operation more easily, more certainly and more rapidly than previously known machines for this purpose.

A further object of the invention is that of providing improved apparatus for opening signatures, which is capable of treating a greater number of signatures in a given amount of time than has been possible before now with conventional signature-opening machines.

SUMMARY OF THE INVENTION

The present invention provides apparatus for opening signatures comprising

- a closed loop conveyor means, said closed loop conveyor means having a concavely curved section,
- means for depositing signatures to be opened onto said concavely curved section of said closed loop conveyor means in use of said apparatus,
- a plurality of rotatable sucker members disposed above said concave curved section of said closed loop conveyor means,

- a support frame carrying said plurality of rotatable sucker members, and
- drive means connected to said support frame, said drive means operating to cause said support frame to perform reciprocating arcuate movements which follows the curve of said concave section of said closed loop conveyor means.

Other features and advantages of the present invention will become apparent from a study of the following detailed description in which reference will be made to the accompanying drawings, provided purely by way of non-limitative example.

DESCRIPTION OF THE PREFERRED EMBODIMENTS

Figure 5:
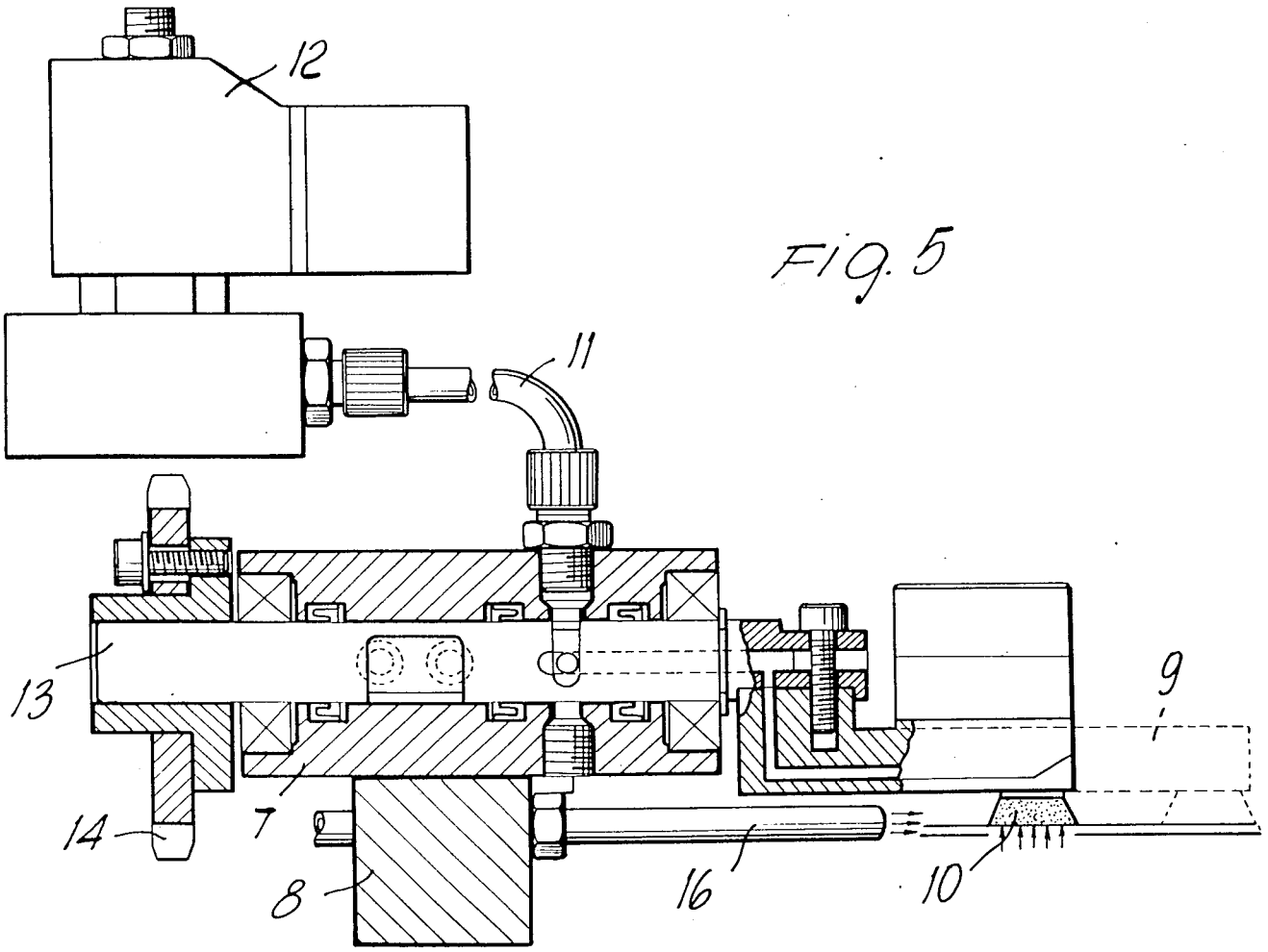
FIG. 5 is a sectional view showing the structure of one of the said rotating sucker heads.

The improved apparatus for opening signatures shown in the drawings comprises an endless conveyor belt 1 carried substantially between two drums 2, 3 and having an upper section 1' which follows an arcuate path which is upwardly concave. Because of this arrangement, signatures 4 taken by means of gripper members 5, of known type from a magazine 6 and released onto the conveyor 1, are forced to assume a slight curvature which gives them a greater rigidity in the transverse sense. Above the upwardly concave arcuate section 1' of the conveyor 1 there are positioned a plurality of sucker heads 7 mounted on a frame 8 having the same curvature as the said concave arcuate section 1' of the conveyor 1. Each of the sucker heads 7 carries a respective hollow eccentric bar 9 on which is or are fitted one or more suckers 10 in communication, through a duct 11 with a suction device controlled by a solenoid valve 12, (see FIG. 5). The eccentric bar 9 is connected to a spindle 13 which carries a sprocket 14 for rotation therewith, which sprocket engages a slidable chain 15 which acts as a rack causing rotation of the sprocket 14 and thus of the spindle 13 upon linear displacement of the chain 15. A blower device 16 is provided in association with each eccentric bar 9, and is positioned, as shown in FIG. 5, to direct a stream of air parallel to the sheets of the signatures. The blower 16 is activated when the suction of the sucker 10 is commenced, and acts to cause the sheets to separate easily thus preventing unwanted lifting of other sheets of the signature.

Figure 1:
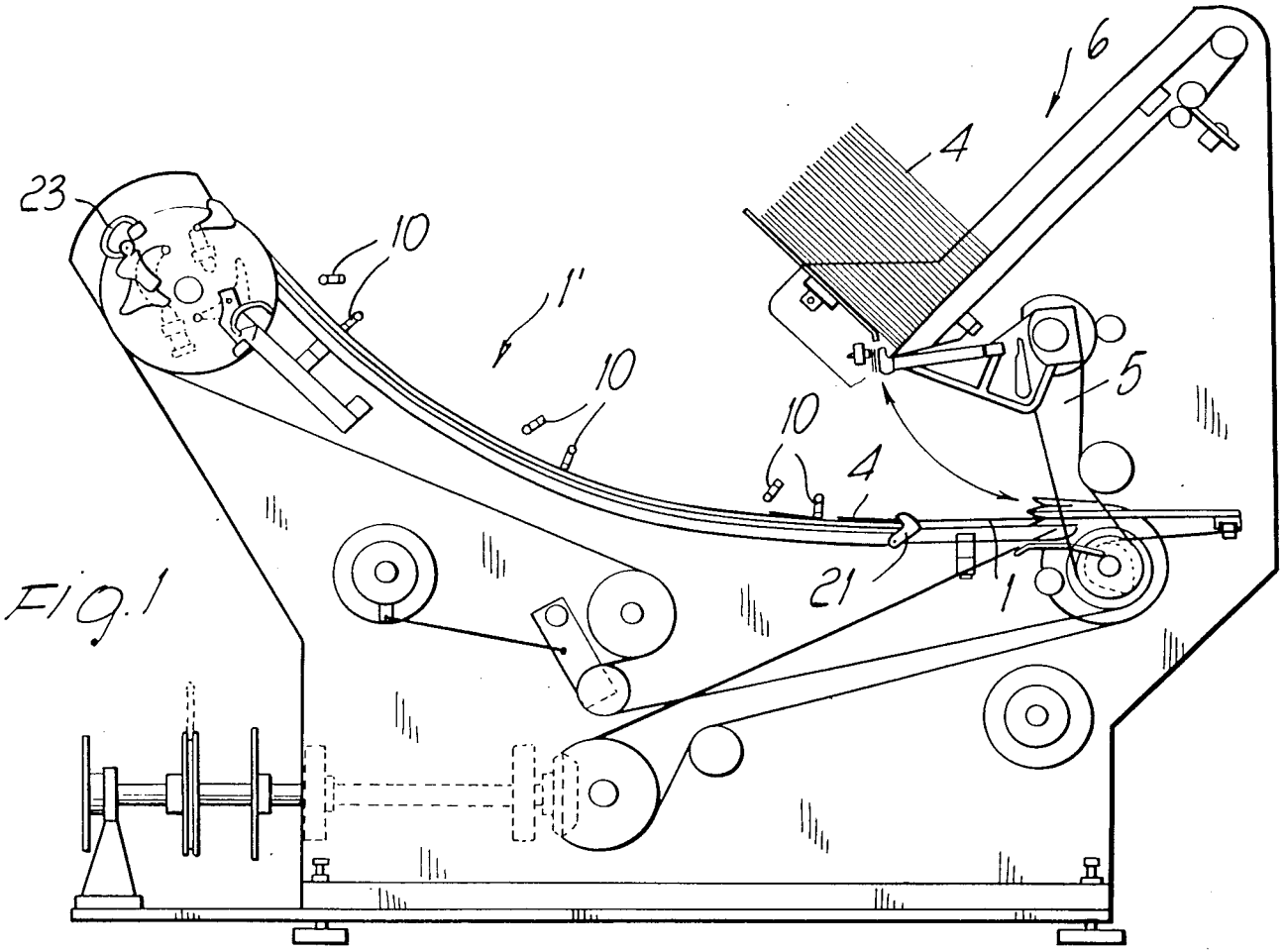
FIG. 1 is a schematic side view of a signature-opening machine formed as an embodiment of the invention.
Figure 2:
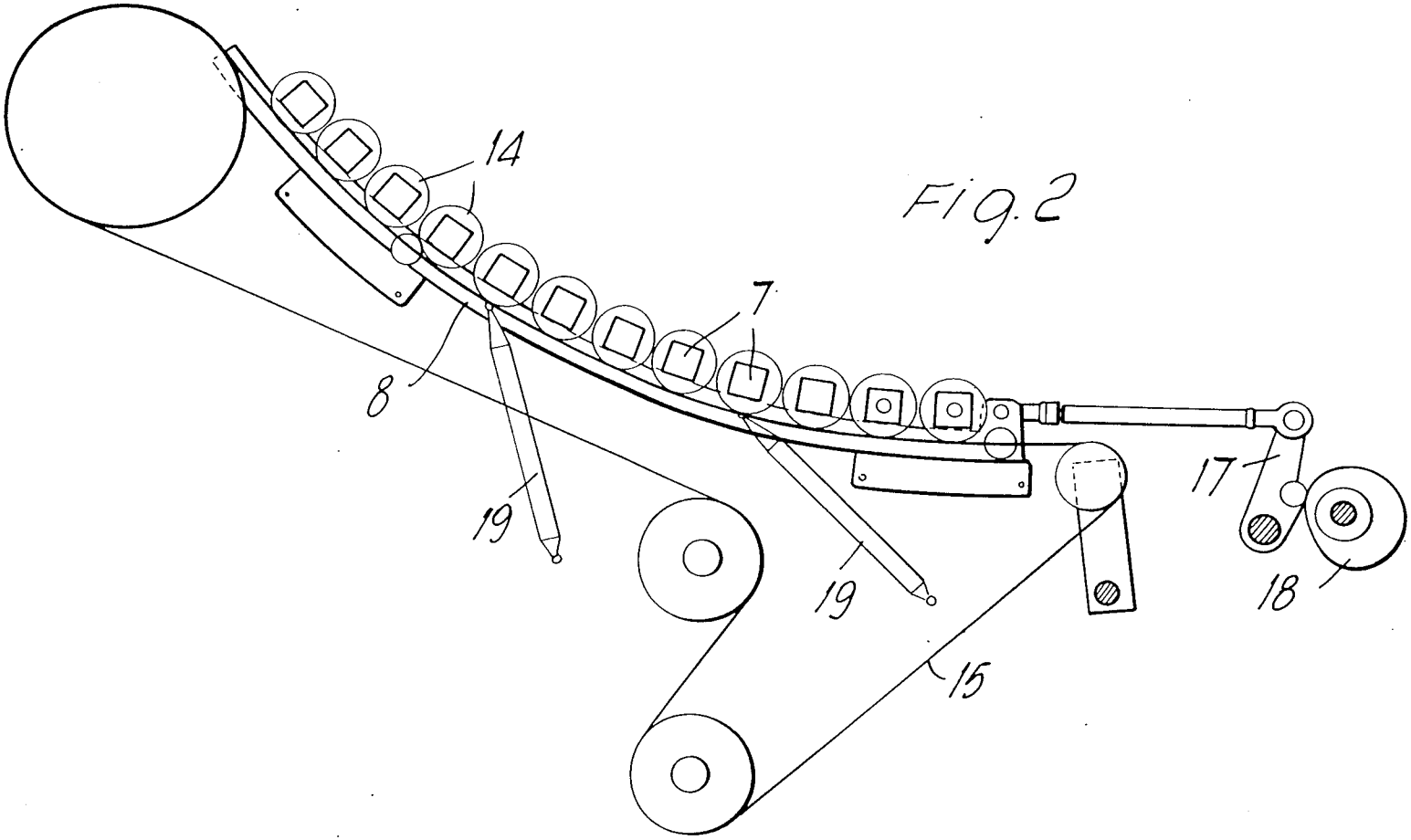
FIG. 2 is a schematic side view of the movable assembly of the embodiment, carrying the rotating sucker heads.

As can be seen in FIG. 2, the frame 8 carrying the rotating sucker heads 7 is linked by a rod to an arm 17 carrying a cam follower on which acts a cam 18 which is so shaped as to cause the frame 8 to perform a periodic reciprocating movement guided by two articulated link arms 19. The control mechanisms for the mechanical movement of the frame 8 carrying the sucker heads 7 and for the activation of the suckers 10 and the blowers 16 are synchronised with one another in such a way that the frame 8 is moving in the same direction as the signatures when the suckers 10 are connected to the suction source so that the uppermost sheet of a signature is raised and turned back by the movement of the head 7. Subsequently, during the return movement of the frame 8 the suckers are no longer connected to the suction source, but still act in cooperation with auxiliary means, to maintain the signature open. This arrangement ensures that the relative speed of the signatures and the suckers is reduced so that each signature effectively "sees" the suckers roll at a speed lower than the speed of advancement of the conveyor. Thus, at a given speed of transport, there will be a more delicate working. Moreover, since the signatures are slightly curved by the concave curvature of the conveyor 1 they are, as previously indicated, more rigid in a transverse sense, and thus automatically better able to resist transverse flexure making the operation of the rotating suckers in raising the sheets more certain. Obviously, the number of suckers (or sets of suckers) provided over the length of the conveyor section 1' will be matched to the number of sheets in the signatures to be opened so that the appropriate number of sheets can be raised to open the signatures in the middle.

Figures 3, 4:
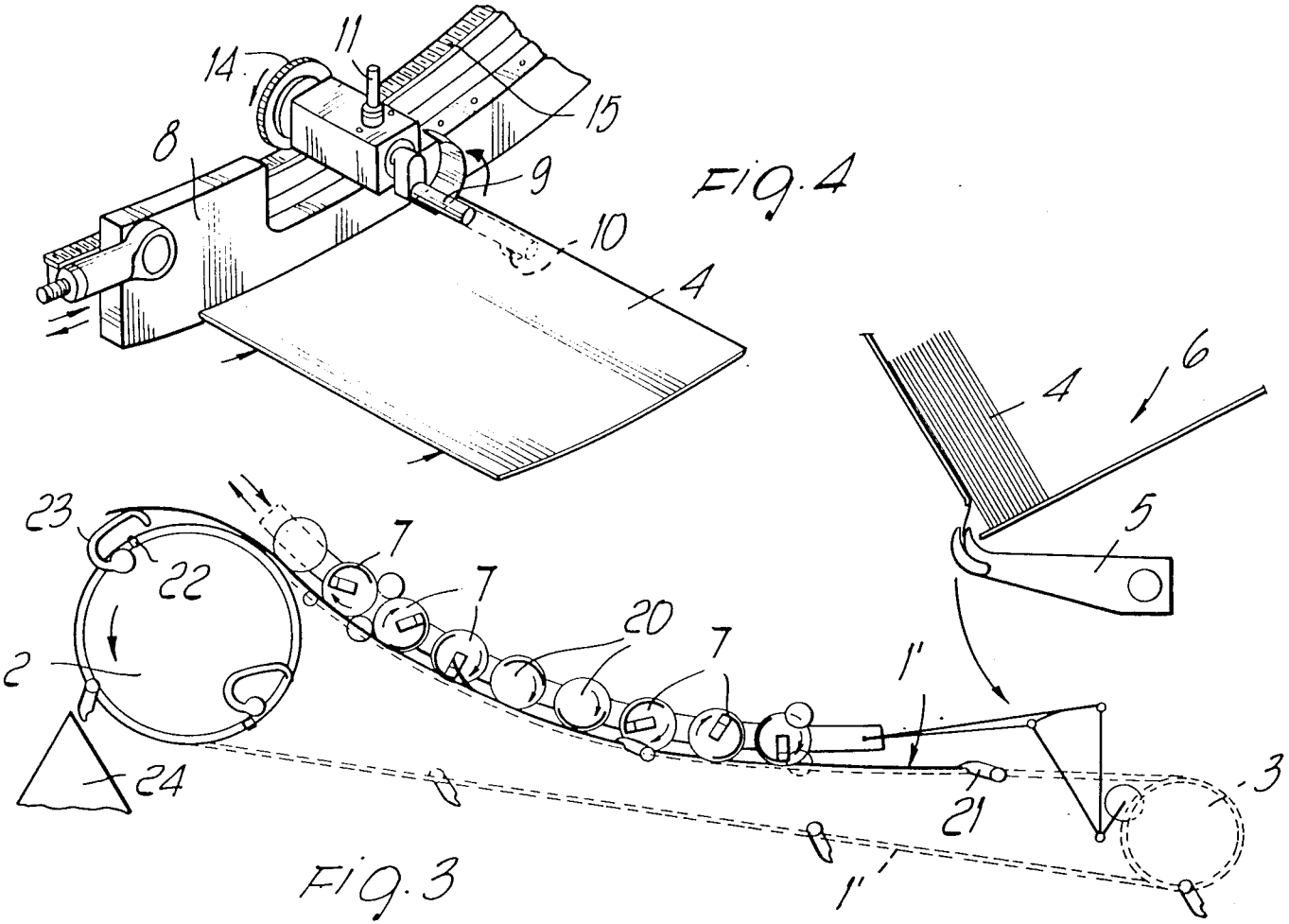
FIG. 3 is a schematic side view showing the manner of operation of the apparatus of the present invention.
FIG. 4 is a perspective view showing one of the rotating sucker heads, together with the associated linkage for effecting movement thereof.
Figure 6:
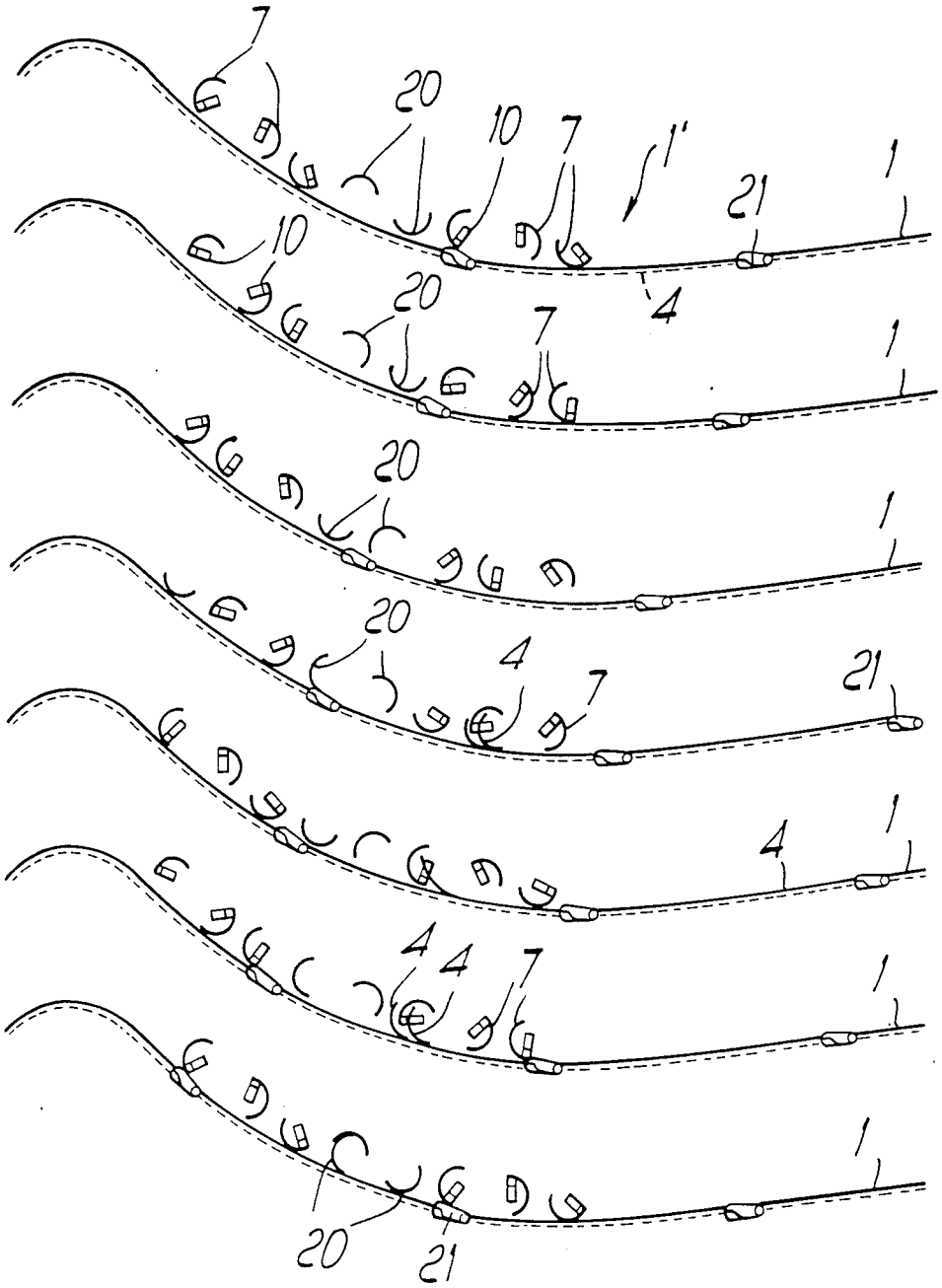
FIG. 6 is a set of diagrams schematically illustrating the sequence of operations of the heads themselves.

If, because of particular mechanical requirements, the individual suckers (or sets of suckers if there are a plurality on each bar 9) must be joined in two or more groups, the movable frame may also be provided with a suitable number of continuity elements such as those shown in FIGS. 3 and 6 and indicated with the reference numeral 20, operable to prevent the re-closure of the signatures as they move between adjacent suckers or sets of suckers. Of course it will be understood that the suckers are active during that movement of the movable frame 8 when the axes about which they rotate follow the signatures.

In the apparatus of the present invention there are further provided grippers 21, known per se, operable to secure the signatures onto the conveyor, and retainer members 22, 23, also of known type, operable to grip the lower half of the signature itself to position it correctly straddling a saddle.

What is claimed is:

1. Apparatus for opening signatures comprising:

a closed loop conveyor means, said closed loop conveyor means having a concavely curved section, means for depositing signatures to be opened onto said concavely curved section of said closed loop conveyor means in use of said apparatus, a plurality of rotatable sucker members disposed above said concave curved section of said closed loop conveyor means, a support frame carrying said plurality of rotatable sucker members, and drive means connected to said support frame, said drive means operating to cause said support frame to perform reciprocating arcuate movements which follow the curve of said concave section of said closed loop conveyor means.

2. The apparatus of claim 1, wherein said rotatable sucker members are mounted on hollow bars carried eccentrically on and rotatably coupled to respective suction heads, a duct connecting said mounting bars to a suction source, and a solenoid valve controlling communication between said suction device and said hollow mounting bars.

3. The apparatus of claim 2, wherein each of said eccentric bars is mounted on a spindle, a sprocket rigidly connected to said spindle, said sprocket being engaged by a chain serving as a rack to cause turning movement of said bar about said spindle.

4. The apparatus of claim 1, wherein a blower is provided adjacent each said sucker member;

control means of said apparatus being provided for activating said blowers whenever the associated said sucker member is in operation whereby to avoid unwanted lifting of sheets of a said signature other than the sheet thereof engaged by said sucker.

5. The apparatus of claim 1 wherein said movable support frame carrying said suction heads is linked to a displacement mechanism including a pivoted arm engaged by a cam, said movable support frame being constrained by articulated link arms to perform said reciprocating arcuate movements.

6. The apparatus of claim 1, further including control means for determining activation of said sucker members, said control means being phased to activate said sucker members when said support frame is moving in the same direction as said signatures on said concave section of said closed loop conveyor means.

7. The apparatus of claim 2, wherein there are further provided means for maintaining said signatures in the open state after said suckers have been disconnected from said suction source.

8. The apparatus of claim 1, wherein said rotatable suckers are joined in groups and there are further provided continuity elements between adjacent said groups of suckers, said continuity elements operating to prevent re-closure of said signatures as they are moved on said conveyor from one group of said suckers to another.

9. The apparatus of claim 6, wherein said control means for determining activation of said rotatable suckers is phased to activate said suckers when said movable frame is travelling in the same direction as said suckers.

* * * * *